US008666646B2

(12) United States Patent
Zaitsu et al.

(10) Patent No.: US 8,666,646 B2
(45) Date of Patent: Mar. 4, 2014

(54) VEHICLE GUIDANCE DEVICE, VEHICLE GUIDANCE METHOD, AND VEHICLE GUIDANCE PROGRAM

(75) Inventors: Tomoyuki Zaitsu, Okazaki (JP); Kenji Nagase, Okazaki (JP); Kazunori Watanabe, Toyota (JP); Tooru Yamazaki, Kariya (JP)

(73) Assignees: Aisin AW Co., Ltd., Anjo (JP); Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 0 days.

(21) Appl. No.: 13/510,443

(22) PCT Filed: Dec. 2, 2010

(86) PCT No.: PCT/JP2010/072066

§ 371 (c)(1),
(2), (4) Date: May 17, 2012

(87) PCT Pub. No.: WO2011/074462

PCT Pub. Date: Jun. 23, 2011

(65) Prior Publication Data

US 2012/0245833 A1 Sep. 27, 2012

(30) Foreign Application Priority Data

Dec. 14, 2009 (JP) ..... 2009-283249

(51) Int. Cl.
*G08G 1/16* (2006.01)

(52) U.S. Cl.
USPC ..... 701/117; 701/118; 701/300; 701/301; 340/995.19

(58) Field of Classification Search
USPC ..... 701/117, 118, 300, 301; 340/995.19
See application file for complete search history.

(56) References Cited

U.S. PATENT DOCUMENTS

2005/0256630 A1* 11/2005 Nishira et al. ..... 701/96
2007/0124072 A1* 5/2007 Nakayama et al. ..... 701/211

FOREIGN PATENT DOCUMENTS

| | | | |
|---|---|---|---|
| CN | 1576792 | A | 2/2005 |
| CN | 1737876 | A | 2/2006 |
| EP | 1 598 233 | A2 | 11/2005 |
| JP | A-03-118698 | | 5/1991 |
| JP | A-09-245299 | | 9/1997 |
| JP | B2-3301386 | | 7/2002 |
| JP | A-2004-185504 | | 7/2004 |
| JP | A-2004-286559 | | 10/2004 |
| JP | A-2007-003251 | | 1/2007 |

(Continued)

OTHER PUBLICATIONS

Office Action issued in Japanese Application No. 2009-283249 dated Nov. 2, 2011 (with partial translation).

(Continued)

*Primary Examiner* — Mary Cheung
*Assistant Examiner* — Brian P Sweeney
(74) *Attorney, Agent, or Firm* — Oliff PLC

(57) ABSTRACT

A vehicle guidance device includes: an inter- vehicle distance specification unit that specifies an inter-vehicle distance, which is an inter-vehicle distance in a prescribed lane, between vehicles up to a reference point of a lane change; a recommended section specification unit that ,based on the specified inter-vehicle distance, specifies a recommended section in which a lane change to the prescribed lane should be made before reaching the reference point; and a communication unit that, based on the specified recommended section, outputs guidance information pertaining to the lane change to the prescribed lane.

4 Claims, 9 Drawing Sheets

(56) References Cited

FOREIGN PATENT DOCUMENTS

| | | |
|---|---|---|
| JP | A-2007-071579 | 3/2007 |
| JP | A-2007-139531 | 6/2007 |
| JP | A-2007-147577 | 6/2007 |
| JP | A-2007-241439 | 9/2007 |
| JP | A-2008-203100 | 9/2008 |

OTHER PUBLICATIONS

International Search Report issued in International Application No. PCT/JP2010/072066 dated Mar. 29, 2011.
Chinese Patent Office, Notification of Reason(s) for Refusal mailed Nov. 27, 2013 in Chinese Patent Application No. 201080051537.0 w/Partial English-language Translation.

* cited by examiner

[TOLERANCE TABLE]

| RELATIVE VEHICLE SPEED (ABSOLUTE VALUE) | TOLERANCE |
|---|---|
| 20 KM/H OR MORE | 4 |
| 10 KM/H OR MORE BUT LESS THAN 20 KM/H | 3 |
| LESS THAN 10 KM/H | 2 |

FIG. 9

〔TOLERANCE TABLE〕

| REFERENCE POINT | LANE | TOLERANCE |
|---|---|---|
| 10010 | 1001011 | 4 |
| | 1001012 | 3 |
| ⋮ | ⋮ | ⋮ |

VEHICLE GUIDANCE DEVICE, VEHICLE GUIDANCE METHOD, AND VEHICLE GUIDANCE PROGRAM

TECHNICAL FIELD

The present invention relates to a vehicle guidance device, a vehicle guidance method, and a vehicle guidance program.

BACKGROUND ART

Known vehicle guidance devices have been used to acquire traffic information pertaining to traffic regulations, congestion, and the like from a distribution center, and output guidance based on the traffic information. For example, a vehicle route guidance device has been proposed that sets a plurality of congestion check points before a branch point on a route to a destination. Branch guidance is performed when the vehicle reaches a check point on a side distant from the branch point among a prescribed number of consecutive congestion points determined as not congested (see Japanese Patent Application Publication No. JP-A-2008-203100, for example).

CITATION LIST

Patent Literature

PTL 1: Japanese Patent Application Publication No. JP-A-2008-203100.

SUMMARY OF INVENTION

Technical Problem

However, even if branch guidance is performed that requires a lane change, the device according to the related art described in JP-A-2008-203100 does not give any consideration to an inter-vehicle distance in a destination lane to be traveled after the lane change. As a consequence, for example, when there is no congestion before the branch point, branch guidance is performed at a point that is a prescribed distance away from the branch point. However, at the position where the branch guidance is performed, there may not be enough inter-vehicle distance in the destination lane to be traveled after the lane change, making a lane change difficult.

The present invention was devised in light of the foregoing, and provides a vehicle guidance device, a vehicle guidance method, and a vehicle guidance program, which perform guidance that facilitates a lane change depending on a lane traffic condition.

Solution to Problem

In order to address the foregoing circumstances and achieve the above, a vehicle guidance device according to a first aspect of the present invention includes: an inter-vehicle distance specification unit that specifies an inter-vehicle distance, which is an inter-vehicle distance in a prescribed lane, between vehicles up to a reference point of a lane change; a recommended section specification unit that, based on the specified inter-vehicle distance, specifies a recommended section in which a lane change to the prescribed lane should be made before reaching the reference point; and an output unit that, based on the specified recommended section, outputs guidance information pertaining to the lane change to the prescribed lane.

According to the vehicle guidance device of a second aspect of the present invention, the vehicle guidance device of the first aspect further includes: a tolerable inter-vehicle distance specification unit that specifies a tolerable inter-vehicle distance, which is an inter-vehicle distance in the prescribed lane, within which a lane change to the prescribed lane is tolerated, wherein the recommended section specification unit sets a plurality of determination sections in the prescribed lane within a range up to the reference point, and among the set determination sections, specifies as the recommended section a determination section in which the inter-vehicle distance specified by the inter-vehicle distance specification unit is equal to or greater than the tolerable inter-vehicle distance specified by the tolerable inter-vehicle distance specification unit.

According to the vehicle guidance device of a third aspect of the present invention, in the vehicle guidance device of the second aspect, the tolerable inter-vehicle distance specification unit specifies a vehicle speed difference between a reference vehicle speed within each determination section of a vehicle traveling in the prescribed lane and a reference vehicle speed within a section that corresponds to each determination section of a vehicle traveling in an origin lane of a lane change to the prescribed lane, and specifies the tolerable inter-vehicle distance based on the specified vehicle speed difference.

A vehicle guidance method according to a fourth aspect of the present invention includes: specifying an inter-vehicle distance, which is an inter-vehicle distance in a prescribed lane, between vehicles up to a reference point of a lane change; specifying, based on the specified inter-vehicle distance, a recommended section in which a lane change to the prescribed lane should be made before reaching the reference point; and outputting, based on the specified recommended section, guidance information pertaining to the lane change to the prescribed lane.

A vehicle guidance program according to a fifth aspect of the present invention executes in a computer the vehicle guidance method of the fourth aspect.

Advantageous Effects of Invention

According to the vehicle guidance device of the first aspect, the vehicle guidance method of the fourth aspect, and the vehicle guidance program of the fifth aspect of the present invention, an inter-vehicle distance, which is an inter-vehicle distance in a prescribed lane, is specified between vehicles up to a reference point of a lane change. Based on the specified inter-vehicle distance, a recommended section in which a lane change to the prescribed lane should be made before reaching the reference point is specified. Based on the specified recommended section, guidance information pertaining to the lane change to the prescribed lane is output. Therefore, it is possible to output guidance so as to enable an easy lane change in a section where there is a large inter-vehicle distance in the destination lane of the lane change. Guidance can thus be performed to facilitate a lane change to the lane.

According to the vehicle guidance device of the second aspect of the present invention, a plurality of determination sections is set in the prescribed lane within a range up to the reference point. Among the set determination sections, a determination section in which the inter-vehicle distance specified by the inter-vehicle distance specification unit is equal to or greater than a tolerable inter-vehicle distance specified by the tolerable inter-vehicle distance specification unit is specified as the recommended section. Therefore, it is possible to output guidance pertaining to a lane change in a section where a lane change is easy and there is a large inter-vehicle distance equal to or greater than the inter-vehicle distance tolerance for performing a lane change. Guidance can thus be performed that further facilitates a lane change.

According to the vehicle guidance device of the third aspect of the present invention, a vehicle speed difference is specified between a reference vehicle speed within each determination section of a vehicle traveling in the prescribed lane and a reference vehicle speed within a section that corresponds to each determination section of a vehicle traveling in an origin lane of a lane change to the prescribed lane. The inter-vehicle distance is specified based on the specified vehicle speed difference. Therefore, it is possible to perform guidance that considers an inter-vehicle distance tolerance that differs depending on the relative vehicle speed between lanes.

BRIEF DESCRIPTION OF DRAWINGS

FIG. 9 is a chart that illustrates the tolerance table according to a second embodiment.

DESCRIPTION OF EMBODIMENTS

Hereinafter, embodiments of a vehicle guidance device, a vehicle guidance method, and a vehicle guidance program according to the present invention will be described in detail with reference to the drawings. However, the scope of the present invention is not limited to such embodiments.

First Embodiment

A first embodiment of the present invention will be explained here. The first embodiment is a form that specifies a tolerable inter-vehicle distance based on a vehicle speed difference between a reference vehicle speed in a prescribed lane and a reference vehicle speed in an origin lane of a lane change.

Constitution

Figure 1:
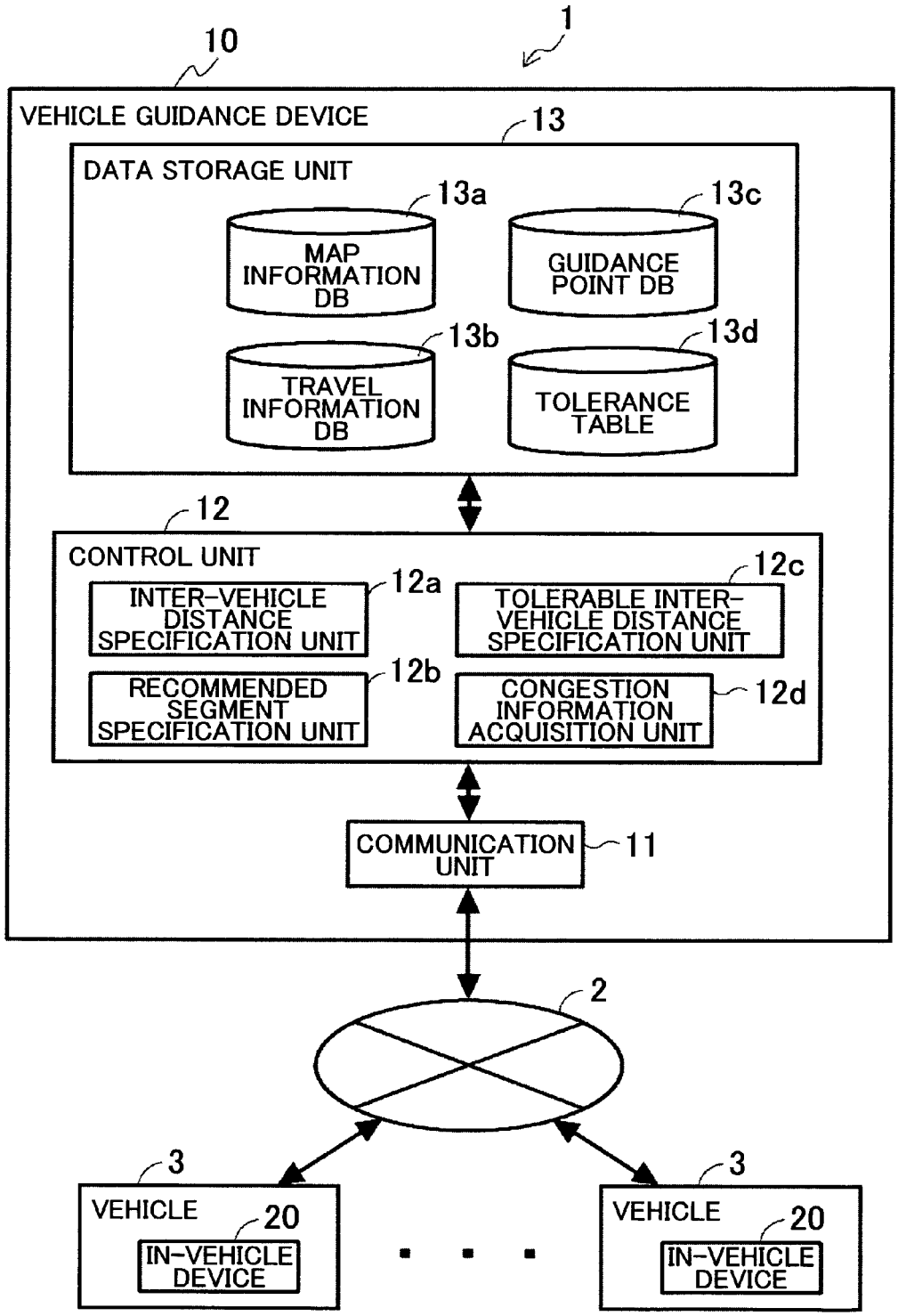
FIG. 1 is a block diagram that illustrates a vehicle guidance system.

The constitution of a vehicle guidance system according to the present embodiment will be described first. FIG. 1 is a block diagram that illustrates the vehicle guidance system. As shown in FIG. 1, a vehicle guidance system 1 includes a vehicle guidance device 10, and an in-vehicle device 20 that is installed in a vehicle 3. The vehicle guidance device 10 and the in-vehicle device 20 are inter-communicably connected through a network 2.

Constitution: Vehicle Guidance Device

The vehicle guidance device 10 includes a communication unit 11, a control unit 12, and a data storage unit 13.

Constitution: Vehicle Guidance Device—Communication Unit

The communication unit 11 is a communication unit that communicates with the in-vehicle device 20 through the network 2, and also an output unit that outputs guidance information pertaining to a lane change to the in-vehicle device 20. A commonly known wired and/or wireless communication device may be used as the communication unit 11.

Constitution: Vehicle Guidance Device—Control Unit

The control unit 12 controls the vehicle guidance control device 10. Specifically, the control unit 12 is a computer with a configuration that includes a CPU, various programs that are interpreted and executed in the CPU (including an OS and other basic control programs, and application programs that are activated in the OS to carry out specific functions), and an internal memory such as a RAM for storing the programs and various data. In particular, the vehicle guidance program according to the present embodiment is installed in the vehicle guidance device 10 through any storage medium or the network 2, and configures various portions of the control unit 12 in substance (the same applies to a control unit 21 of the in-vehicle device 20 that will be described later).

The control unit 12 includes an inter-vehicle distance specification unit 12*a*, a recommended section specification unit 12*b*, a tolerable inter-vehicle distance specification unit 12*c*, and a congestion information acquisition unit 12*d* in terms of functional concept.

The inter-vehicle distance specification unit 12*a* specifies an inter-vehicle distance in the prescribed lane. The recommended section specification unit 12*b* specifies a recommended section in which a lane change should be made to the prescribed lane. The tolerable inter-vehicle distance specification unit 12*c* specifies a tolerable inter-vehicle distance that can be tolerated when performing a lane change to the prescribed lane. The congestion information acquisition unit 12*d* acquires congestion information. The processes that are executed by these functional elements of the control unit 12 will be described in detail later.

Constitution: Vehicle Guidance Device—Data Storage Unit

The data storage unit 13 is a storage unit that stores programs and various data required for operation of the vehicle guidance device 10, and has a configuration that uses a hard disk (not shown in the drawing) as an external memory device, for example. However, any other storage mediums, including a magnetic storage medium such as a magnetic disk or an optical storage medium such as a DVD or Blu-ray disc, can be used in place of or in combination with the hard disk (the same applies to a data storage unit 22 of the in-vehicle device 20 that will be described later).

The data storage unit 13 includes a map information database (note that database will be abbreviated to "DB" below) 13*a*, a travel information DB 13*b*, a guidance point DB 13*c*, and a tolerance table 13*d*. The map information DB 13*a* is a map information storage unit that stores map information. The "map information" includes, for example, link data (link number, connection node number, road coordinates, road type, number of lanes, travel regulations, and the like), node data (node number and coordinates), feature data (traffic signals, road signs, guard rails, buildings, and the like), and topography data.

The travel information DB 13*b* is a travel information storage unit that stores travel information acquired from the in-vehicle device 20 in a travel information acquisition process that will be described later. The travel information may include, for example, information that identifies the vehicle 3 for which the travel information is acquired, the time and date when the travel information is acquired, a position at which the travel information is acquired, an inter-vehicle distance between each vehicle 3 and a preceding vehicle 3, a travel lane in which each vehicle 3 is currently traveling, a vehicle speed of each vehicle 3, a degree of congestion, and regulatory information.

The guidance point DB 13*c* is a guidance point information storage unit that stores guidance point information pertaining to a guidance point at which guidance pertaining to a lane change is performed. The guidance point information may include, for example, information for specifying a guidance point, a branch for which a guidance point is specified, a lane for which a guidance point is specified, and an origin lane of a lane change.

Figures 2, 3:
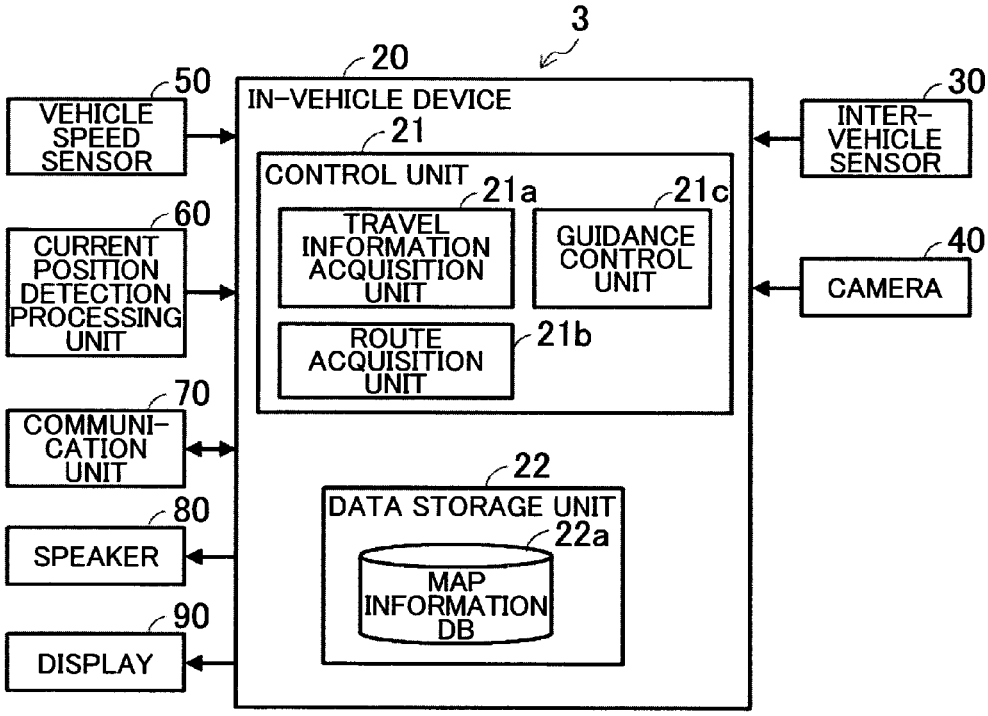
FIG. 2 is a chart that illustrates a tolerance table.
FIG. 3 is a block diagram that illustrates an in-vehicle device installed in the vehicle shown in FIG. 1 and other installed devices.

The tolerance table 13*d* is used as a reference when the tolerable inter-vehicle distance specification unit 12*c* specifies the tolerable inter-vehicle distance. FIG. 2 is a chart that illustrates the tolerance table 13*d*. As shown in FIG. 2, information that corresponds to the table items "Relative Vehicle Speed (Absolute Value)" and "Tolerance" is mutually associated and stored in the tolerance table 13*d*. Information that is stored corresponding to the item "Relative Vehicle Speed (Absolute Value)" specifies an absolute value range of the vehicle speed difference between the reference vehicle speed of the vehicle 3 traveling in the prescribed lane and the reference vehicle speed of the vehicle 3 traveling in an origin lane of a lane change to the prescribed lane. As the reference vehicle speed, an average vehicle speed, a minimum vehicle speed, or a maximum vehicle speed of a plurality of vehicles 3 traveling in the lane may be used, for example. Information that is stored corresponding to the item "Tolerance" consists of tolerances of difficulty when performing a lane change. Here, "difficulty" refers to a determined value that corresponds to a minimum inter-vehicle distance within a fixed section of the prescribed lane. In other words, the vehicle speed difference between the reference vehicle speed of the vehicle 3 traveling in the prescribed lane, and the reference vehicle speed of the vehicle 3 traveling in an origin lane of a lane change to the prescribed lane is used as a basis for determining a tolerance that corresponds to an inter-vehicle distance with which a lane change to the prescribed lane is easily performed. It is determined whether a lane change is easy within a fixed section of the prescribed lane by comparing the above-described difficulty to the tolerance, with the tolerance acting as a threshold. Any method may be used for determining the difficulty. For example, the difficulty may be found as an integer value that is calculated by dividing the minimum inter-vehicle distance by 100 and rounding off to the nearest whole number. In this case, a smaller difficulty corresponds to a smaller minimum inter-vehicle distance, and indicates that performing a lane change is difficult. In the tolerance table 13*d* of FIG. 2, if the absolute value of the vehicle speed difference in the reference vehicle speeds is 20 km/h or more, the corresponding tolerance is 4; if the absolute value of the vehicle speed difference is 10 km/h or more but less than 20 km/h, the corresponding tolerance is 3; and if the absolute value of the vehicle speed difference is less than 10 km/h, the corresponding tolerance is 2. That is, a larger absolute value of the vehicle speed difference between the reference vehicle speeds of two lanes suggests that a lane change between the lanes is more difficult, and therefore the corresponding tolerance is large. On the other hand, a smaller absolute value of the vehicle speed difference between the reference vehicle speeds of two lanes suggests that a lane change between the lanes is easier, and therefore the corresponding tolerance is small. The process that uses the tolerance table 13*d* will be described in detail later.

Constitution: Vehicle

FIG. 3 is a block diagram that illustrates the in-vehicle device 20 installed in the vehicle 3 shown in FIG. 1 and other installed devices. As shown in FIG. 3, the vehicle 3 includes an inter-vehicle sensor 30, a camera 40, a vehicle speed sensor 50, a current position detection processing unit 60, a communication unit 70, a speaker 80, a display 90, and the in-vehicle device 20.

Constitution: Vehicle—Inter-vehicle Sensor

The inter-vehicle sensor 30 measures the inter-vehicle distance between the vehicle 3 installed with the inter-vehicle sensor 30 and a preceding vehicle 3. A commonly known inter-vehicle measurement device such as a laser sensor, a millimeter radar sensor, or the like may be used as the inter-vehicle sensor 30.

Constitution: Vehicle—Camera

The camera 40 is an imaging mechanism that takes images of the area around the vehicle 3. The camera 40 is installed at one or a plurality of locations such as near the front and back bumpers of the vehicle 3, and images the surroundings of the vehicle 3. Data of images imaged by the camera 40 is input to the in-vehicle device 20. Note that the specific constitution of the camera 40 may take on any form, and the camera 40 may be formed using a commonly known imaging element such as a CMOS image sensor or a CCD image sensor, and commonly known optical components such as a fish-eye lens or a prism.

Constitution: Vehicle—Vehicle Speed Sensor

The vehicle speed sensor 50 outputs a vehicle speed pulse signal, which is proportional to a rotational speed of an axle, or the like to the in-vehicle device 20. A commonly known vehicle speed sensor may be used.

Constitution: Vehicle—Current Position Detection Processing Unit

The current position detection processing unit 60 is a current position detection unit that detects a current position of the vehicle 3. Specifically, the current position detection processing unit 60 has at least one of a GPS, a geomagnetic sensor, a distance sensor, and a gyroscopic sensor (none of which are shown in the drawing), and detects the current position (coordinates), heading, and the like of the vehicle 3 using a commonly known method.

Constitution: Vehicle—Communication Unit

The communication unit 70 communicates with the vehicle guidance device 10 through the network 2. A commonly known wireless communication device may be used as the communication unit 70.

Constitution: Vehicle—Speaker

The speaker 80 outputs various types of audio based on a control of the in-vehicle device 20. The specific voice output from the speaker 80 may take on any form, and it is possible to output a synthetic voice that is generated as necessary or a pre-recorded voice.

Constitution: Vehicle—Display

The display 90 outputs various types of images based on a control of the in-vehicle device 20. Note that the specific constitution of the display 90 may take on any form, and a flat panel display such as a commonly known liquid crystal display or organic EL display may be used.

Constitution: Vehicle—In-vehicle Device

As shown in FIG. 3, the in-vehicle device 20 includes a control unit 21 and a data storage unit 22.

Constitution: In-vehicle Device—Control Unit

The control unit 21 controls the in-vehicle device 20, and includes a travel information acquisition unit 21*a*, a route acquisition unit 21*b*, and a guidance control unit 21*c* in terms of functional concept.

The travel information acquisition unit 21*a* acquires travel information based on input from the inter-vehicle sensor 30, the camera 40, the vehicle speed sensor 50, and the current position detection processing unit 60. The route acquisition unit 21*b* acquires a travel route of the vehicle 3; for example, the route acquisition unit 21*b* acquires a travel route set by a commonly known navigation device. The guidance control unit 21*c* performs an output control of guidance pertaining to a lane change. The processes that are executed by these functional elements of the control unit 21 will be described in detail later.

Constitution: In-vehicle Device—Data Storage Unit

The data storage unit 22 is a storage unit that stores programs and various data required for operation of the in-vehicle device 20. The data storage unit 22 includes a map information DB 22*a*. Map information stored in the map information DB 22*a* includes various information stored in the map information DB 13*a* of the vehicle guidance device 10 described above, as well as map display data for displaying a map on the display 90.

Processing

The processing executed by the thus constituted vehicle guidance device 10 and/or in-vehicle device 20 will be explained below. The processing executed by the vehicle guidance device 10 and/or the in-vehicle device 20 is roughly divided into a travel information acquisition process in which the in-vehicle device 20 of each vehicle 3 acquires travel information, a guidance point specification process in which the vehicle guidance device 10 specifies a guidance point at which guidance pertaining to a lane change should be performed, and a guidance process in which the in-vehicle device 20 performs a guidance control related to a lane change. These processes will be explained below.

Processing: Travel Information Acquisition Process

Figure 4:
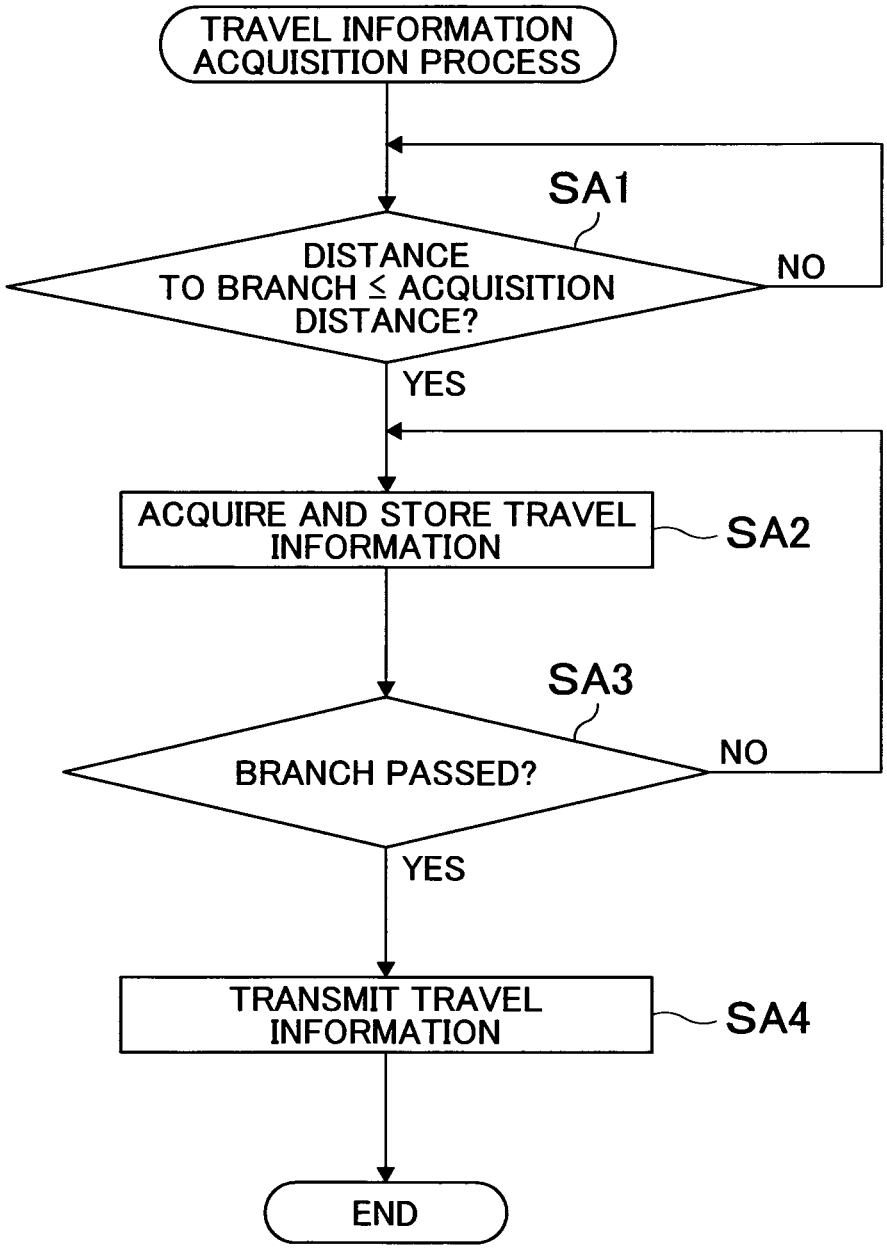
FIG. 4 is a flowchart of a travel information acquisition process.

The travel information acquisition process will be described first. FIG. 4 is a flowchart of the travel information acquisition process (steps in the descriptions of each process below are abbreviated to "S"). The travel information acquisition process is processing executed by the in-vehicle device 20, and is repeatedly activated in predetermined cycles after the in-vehicle device 20 is powered on, for example.

Following activation of the travel information acquisition process, the travel information acquisition unit 21*a* stands by until a distance between the current position of the vehicle 3, which is acquired through the current position detection processing unit 60, and a particular branch ahead of the vehicle 3 becomes an acquisition distance or less, for which traveling information up to the branch should be acquired (SA1: No). Note that the particular branch ahead of the vehicle 3 may be specified based on the current position of the vehicle 3 as acquired through the current position detection processing unit 60, the direction in which the vehicle 3 is traveling as specified through a heading sensor (not shown in the drawings), and the map information stored in the map information DB 22*a*. In addition, the acquisition distance may be any specific value. For example, as a maximum distance at which guidance pertaining to a lane change before the branch should be performed, a distance of 5000 meters from the branch may be set as the acquisition distance.

If the distance between the current position of the vehicle 3 and the particular branch ahead of the vehicle 3 becomes the acquisition distance or less (SA1: Yes), the travel information acquisition unit 21*a* acquires as the travel information, for example, the identifying information of the vehicle 3, the current date and time, the current position, the inter-vehicle distance to the preceding vehicle 3, the travel lane in which the vehicle 3 is traveling, the vehicle speed, the degree of congestion, and regulatory information. The acquired travel information is stored in a commonly known storage unit such as a RAM (not shown in the drawings) (SA2). For example, the travel information acquisition unit 21*a* specifies the current date and time based on standard time information that is received from a GPS satellite, and specifies the current position of the vehicle 3 through the current position detection processing unit 60. In addition, the travel information acquisition unit 21*a* specifies the inter-vehicle distance to the preceding vehicle 3 through the inter-vehicle sensor 30, and specifies the vehicle speed of the vehicle 3 through the vehicle speed sensor 50. Further, the travel information acquisition unit 21*a* may specify the travel lane based on the current position of the vehicle 3 as specified through the current position detection processing unit 60 and the map information. Alternatively, a lane line may be extracted from an image taken by the camera 40 of a surrounding area of the vehicle 3, and the travel lane specified based on the position of the lane line. The degree of congestion at the current position is specified based on the specified vehicle speed. Moreover, regulatory signs that indicate travel regulations in effect are extracted from the image taken by the camera 40 of the surrounding area of the vehicle 3, and the regulatory information for the travel lane is acquired based on the regulatory signs.

Next, the travel information acquisition unit 21*a* determines whether the vehicle 3 has passed the particular branch ahead of the vehicle 3, based on the current position of the vehicle 3 acquired through the current position detection processing unit 60 (SA3). If it is consequently determined that the vehicle 3 has not passed the branch (SA3: No), the routine returns to SA2 and travel information acquisition unit 21*a* acquires and stores the travel information (SA2). However, if it is determined that the vehicle 3 has passed the branch (SA3: Yes), the travel information acquisition unit 21*a* transmits the travel information stored in the RAM at SA2 to the vehicle guidance device 10 through the communication unit 70 (SA4). The travel information acquisition process is then ended. The vehicle guidance device 10 sequentially stores the travel information that is transmitted from the in-vehicle device 20 at SA4 through the communication unit 70 in the travel information DB 13*b*.

Processing: Guidance Point Specification Process

Figure 5:
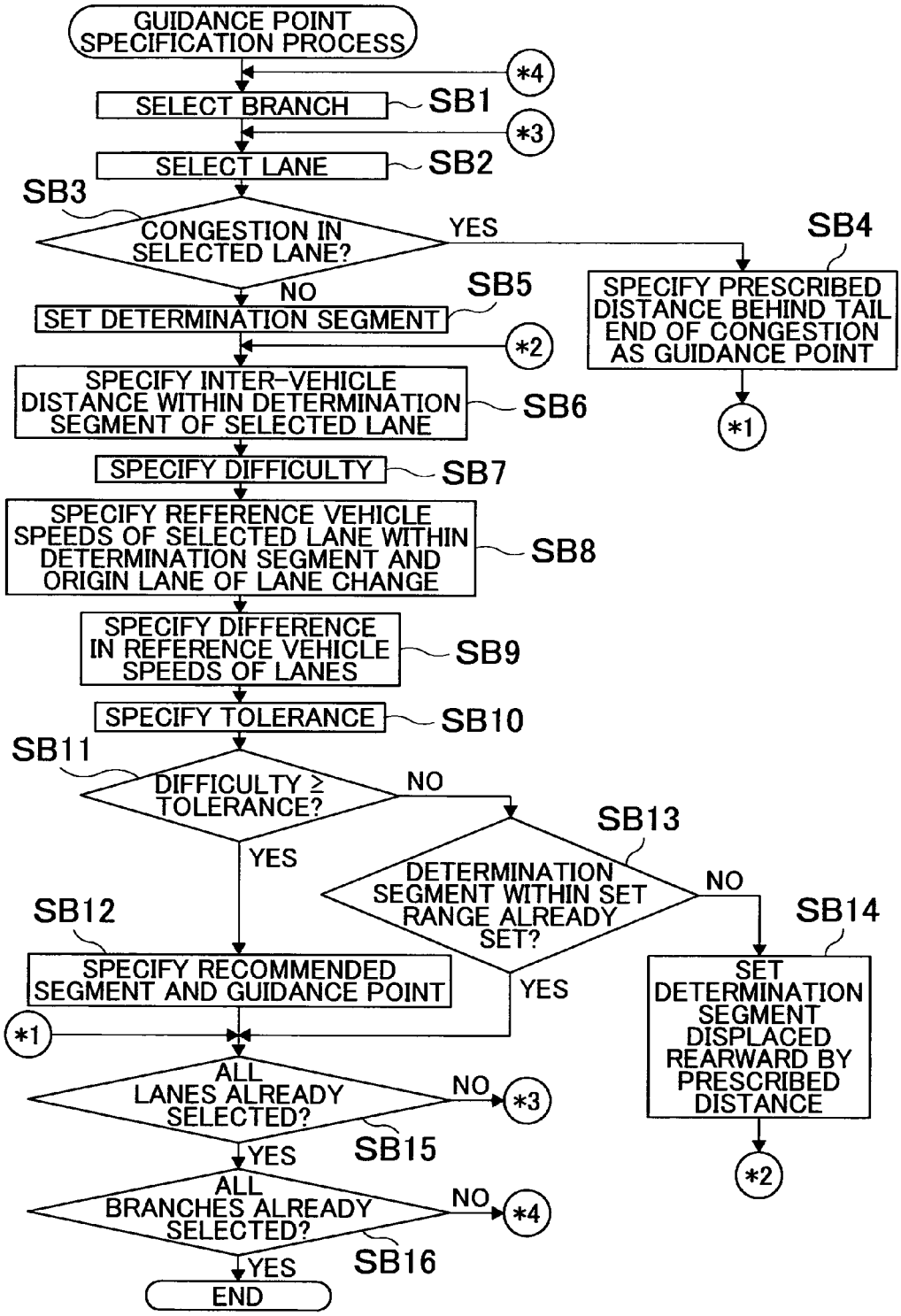
FIG. 5 is a flowchart of a guidance point specification process.

The guidance point specification process will be described next. FIG. 5 is a flowchart of the guidance point specification process. The guidance point specification process is processing executed by the vehicle guidance device 10, and is repeatedly activated in predetermined cycles after the vehicle guidance device 10 is powered on, for example.

Figure 6:
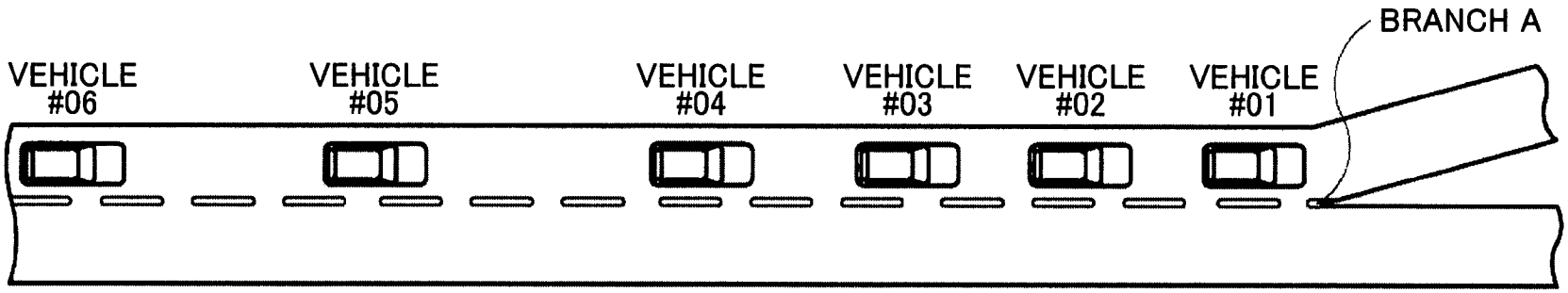
FIG. 6 is a plan view that illustrates a lane and a branch for which the guidance point specification process is performed.

Following activation of the guidance point specification process, the recommended section specification unit 12*b* selects a branch for which to specify a guidance point (SB1). Note that the branch for which to specify a guidance point may be any branch. As an example, the first embodiment describes a case in which a branch on an expressway (e.g. an interchange, junction, or the like) is used as the branch for which to specify a guidance point. Moreover, any method may be used for selecting the branch. For example, the link data and the node data in the map information may be referenced, and nodes (branches) connecting a plurality of roads may be selected in the sequence of the node numbers. FIG. 6 is a plan view that illustrates a lane and a branch for which the guidance point specification process is performed. For example, a branch A in FIG. 6 is selected at SB1.

Returning to FIG. 5, the recommended section specification unit 12*b* selects a lane for which to specify a guidance point (SB2). Any method may be used for selecting the lane.

For example, in the direction of travel, lanes may be sequentially selected starting from the left side. In FIG. 6, as an example, the left lane in direction of travel (the upper lane in FIG. 6) is selected at SB2.

Returning to FIG. 5, the congestion information acquisition unit 12*d* acquires the congestion information, and determines whether there is congestion in the lane selected at SB2 based on the acquired congestion information (SB3). For example, among the travel information stored in the travel information DB 13*b*, the congestion information acquisition unit 12*d* references the degree of congestion stored associated with the lane selected at SB2, and determines that there is congestion in the lane if the degree of congestion is equal to or greater than a threshold.

If it is consequently determined that there is congestion in the lane selected at SB2 (SB3: Yes), the recommended section specification unit 12*b* specifies the tail end of the congestion in the lane selected at SB2 based on the travel information stored in the travel information DB 13*b*, and specifies as a guidance point a point at a guidance distance behind the tail end in the lane direction of travel (SB4). The guidance distance may be any specific value. For example, a distance may be used that is sufficient for performing a lane change before reaching the tail end of the congestion, after the in-vehicle device 20 outputs guidance that a lane change should be performed. As an example, if a "vehicle #03" in FIG. 6 is specified as the tail end of the congestion, a point spaced rearward from the "vehicle #03" by the guidance distance is specified as the guidance point. Here, the specified guidance point is associated with the branch selected at SB 1 and the lane selected at SB2, and stored in the guidance point DB 13*c*.

Figure 7:
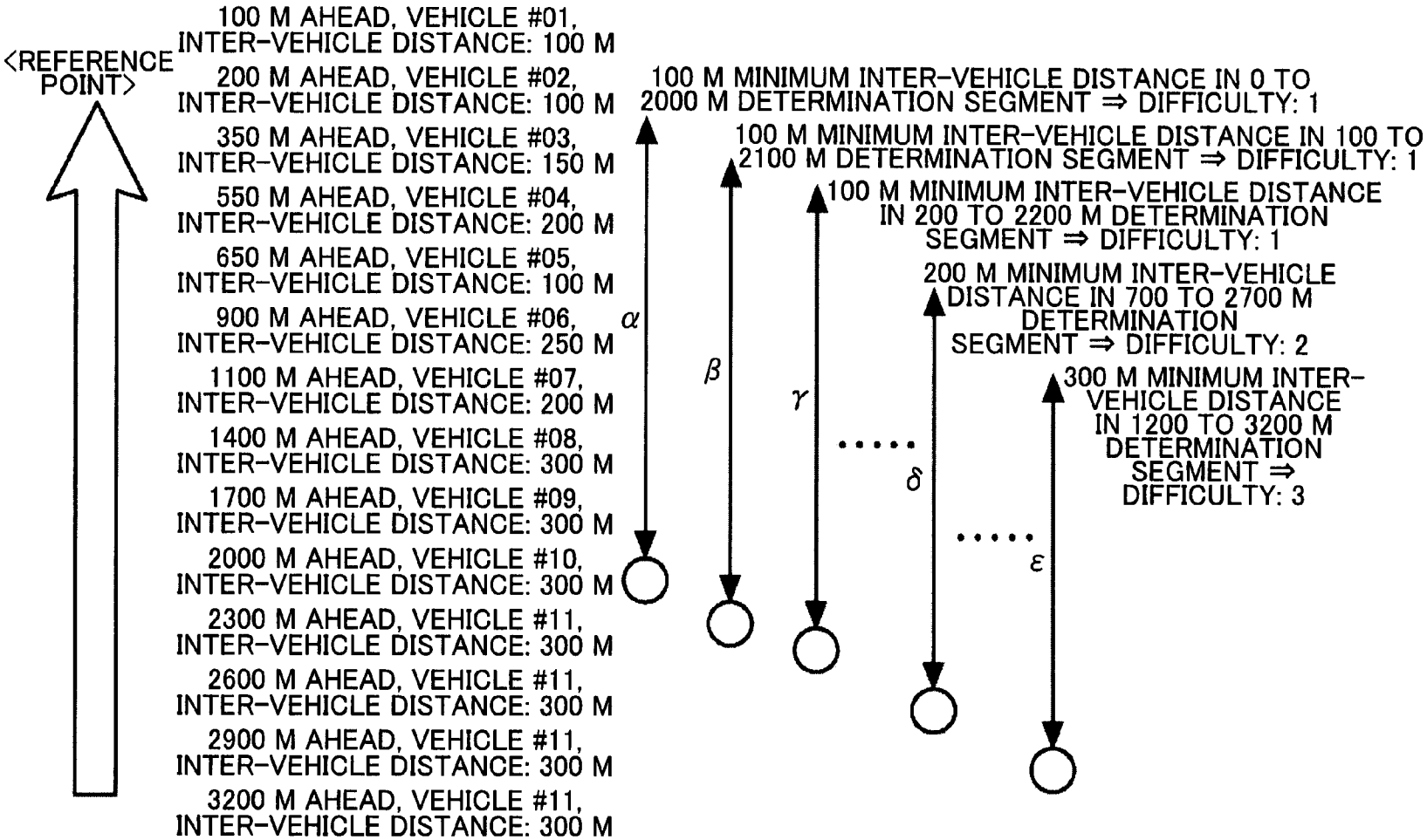
FIG. 7 is a schematic diagram of the relationship between a reference point and a determination section.

Returning to FIG. 5, if it is determined that there is no congestion in the lane selected at SB2 (SB3: No), the recommended section specification unit 12*b* sets in the lane a section that spans from a lane change reference point to a point at a determination distance therebehind in the lane direction of travel as a determination section (SB5). The reference point may be any specific position. For example, the branch selected at SB1 may be used as the reference point. FIG. 7 is a schematic diagram of the relationship between the reference point and the determination section. In the example of FIG. 7, the recommended section specification unit 12*b* sets a section between the reference point and a point at a determination distance (2000 meters) behind the reference point in the lane direction of travel (a point toward the lower side in FIG. 7) as a determination section α. Note that the determination distance may be any specific value. For example, the same distance as the guidance distance described above may be used.

Returning to FIG. 5, the inter-vehicle distance specification unit 12*a* specifies an inter-vehicle distance between the vehicles 3 that exist within the determination section set at SB5 in the lane selected at SB2 (SB6). For example, among the travel information stored in the travel information DB 13*b*, the inter-vehicle distance specification unit 12*a* specifies an inter-vehicle distance that is acquired within the determination section set at SB5 from the inter-vehicle distances stored associated with the lane selected at SB2.

Next, the inter-vehicle distance specification unit 12*a* specifies the difficulty of a lane change in the determination section set at SB5, based on the inter-vehicle distance specified at SB6 (SB7). For example, as described above, the difficulty may be found as an integer value that is calculated by dividing the minimum value of the inter-vehicle distance specified at SB6 by 100 and rounding off to the nearest whole number. In the example of FIG. 7, the minimum inter-vehicle distance of 100 meters in the determination section α set at SB5 divided by 100 equals 1, so the difficulty in the determination section α is specified as 1.

Returning to FIG. 5, the tolerable inter-vehicle distance specification unit 12*c* specifies the reference vehicle speed within the determination section set at SB5 of the vehicle 3 traveling in the lane selected at SB2, and specifies the reference vehicle speed within a section that corresponds to the determination section set at SB5 of the vehicle 3 traveling in an origin lane of a lane change to the lane selected at SB2 (SB8). Here, as the reference vehicle speed, an average vehicle speed, a minimum vehicle speed, or a maximum vehicle speed of a plurality of vehicles 3 traveling in the lane may be used, for example.

The tolerable inter-vehicle distance specification unit 12*c* then specifies a vehicle speed difference between the reference vehicle speed of the vehicle 3 traveling in the lane selected at SB2 and the reference vehicle speed of the vehicle 3 traveling in an origin lane of a lane change to the lane selected at SB2, as specified at SB8 (SB9), and specifies a tolerance based on the specified vehicle speed difference (SB10). Specifically, the tolerable inter-vehicle distance specification unit 12*c* references the tolerance table 13*d* in FIG. 2, and specifies a tolerance that corresponds to the absolute value of the vehicle speed difference between the reference vehicle speeds specified at SB9.

Returning to FIG. 5, the recommended section specification unit 12*b* determines whether the difficulty specified at SB7 is equal to or greater than the tolerance specified at SB10 (SB11). If it is consequently determined that the difficulty is equal to or greater than the tolerance (SB11: Yes), the recommended section specification unit 12*b* specifies the determination section set at SB5 as a recommended section in which the vehicle 3 should perform a lane change to the lane selected at SB2 before reaching the reference point, and specifies a distant end point from the reference point among the end points of the specified recommended section as a guidance point at which guidance pertaining to the lane change should be performed (SB12). In the example of FIG. 7, if the tolerance is 1, the difficulty of the determination section α is 1 and equivalent to the tolerance. Therefore, the determination section α is specified as the recommended section. In addition, a position farthest from the reference point among the determination section α (a position indicated by a circle in FIG. 7) is specified as the guidance point. Here, the specified guidance point is associated with the branch selected at SB1, the lane selected at SB2, and the origin lane of the lane change whose reference vehicle speed is specified at SB8, and stored in the guidance point DB 13*c*.

Returning to FIG. 5, if it is determined that the difficulty is not equal to or greater than the tolerance (if the difficulty is less than the tolerance) (SB11: No), the recommended section specification unit 12*b* determines whether a determination section is already set within a prescribed set range from the reference point in the lane selected at SB2 (SB13). The set range may be any specific value. For example, as a maximum range at which guidance pertaining to a lane change before the reference point should be performed, a range of 5000 meters behind the reference point in the lane direction of travel may be set as the set range.

If it is consequently determined that the determination range is not already set within the set range from the reference point (SB13: No), the recommended section specification unit 12*b* sets a new determination range at a position that is displaced by a prescribed distance behind the determination section set at SB5 in the direction of travel of the lane selected at SB2 (SB14). In the example of FIG. 7, a new determination range β is set at a position displaced 100 meters behind the determination section α set at SB5 in the lane direction of travel (displaced downward in FIG. 7).

In FIG. 5, returning to SB6 after the processing at SB14, the inter-vehicle distance specification unit 12*a* specifies an inter-vehicle distance between the vehicles 3 that exist within the determination section set at SB14 in the lane selected at SB2. Subsequent processing is executed based on the determination section set at SB14 instead of the determination section set at SB5.

However, if it is determined at SB13 that the determination section within the set range from the reference point is already set (SB13: Yes), or following specification of the guidance point at SB4 or SB12, the recommended section specification unit 12*b* determines whether all lanes for the branch specified at SB1 are already selected (SB15). If it is consequently determined that all lanes are not already selected (SB15: No), the routine returns to SB2 and the recommended section specification unit 12*b* selects a lane for which to specify a guidance point (SB2). For example, a lane adjacent to the previously selected lane on the right side in the lane direction of travel may be selected.

However, if it is determined that all lanes for the branch specified at SB1 are already selected (SB15: Yes), the recommended section specification unit 12*b* determines whether all branches included in the map information are already selected (SB16). If it is consequently determined that all branches are not already selected (SB16: No), the routine returns to SB1 and the recommended section specification unit 12*b* selects a branch for which to specify a guidance point (SB1). For example, a node (branch) that corresponds to the next node number after the previously selected node (branch) may be selected.

However, if it is determined that all branches are already selected (SB16: Yes), the recommended section specification unit 12*b* ends the guidance point specification process.

Processing: Guidance Process

Figure 8:
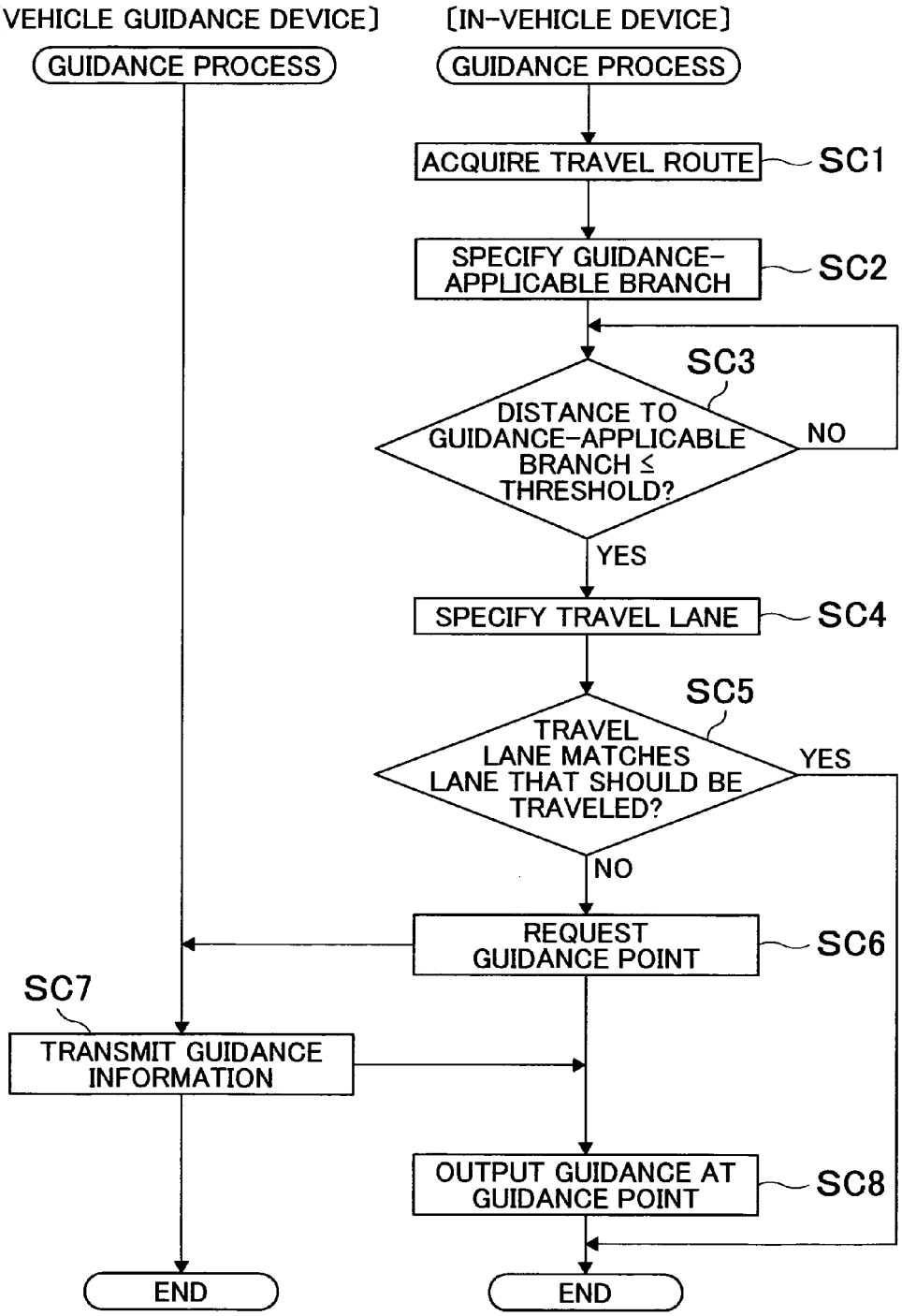
FIG. 8 is a flowchart of a guidance process.

The guidance process will be described next. FIG. 8 is a flowchart of the guidance process. The guidance process is processing executed by the in-vehicle device 20 and the vehicle guidance device 10, and is repeatedly activated in the in-vehicle device 20 and the vehicle guidance device 10 in predetermined cycles after the in-vehicle device 20 and the vehicle guidance device 10 are powered on, for example.

Following activation of the guidance process, the route acquisition unit 21*b* acquires the travel route of the vehicle 3 through a commonly known navigation device (not shown in the drawings) (SC1).

Next, the guidance control unit 21*c* specifies a guidance-applicable branch for which guidance pertaining to a lane change is performed (SC2). The guidance-applicable branch is the nearest branch to the vehicle 3 among branches along the travel route acquired at SC1, for which a specific lane must be traveled to pass through the branch (e.g. if the travel route is set in the direction of a service road of an interchange, the branch of the interchange). The guidance-applicable branch is specified based on the travel route acquired at SC1.

The guidance control unit 21*c* then stands by until the distance between the vehicle 3 and the guidance-applicable branch specified at SC2 is equal to or less than a threshold (SC3: No). The threshold may be any specific value. For example, the threshold may be 5500 meters, that is, the above-described set range that serves as a maximum range at which guidance should be performed with an added margin.

At SC3, if the distance between the vehicle 3 and the guidance-applicable branch specified at SC2 is equal to or less than the threshold (SC3: Yes), the guidance control unit 21*c* specifies the travel lane in which the vehicle 3 is traveling based on input from the current position detection processing unit 60 and the camera 40 (SC4).

Next, the guidance control unit 21*c* determines whether the travel lane specified at SC4 in which the vehicle 3 is actually traveling matches the lane in which the vehicle 3 should be traveling in the travel route acquired at SC1 (SC5). Here, "the lane in which the vehicle 3 should be traveling" refers to a lane in the travel route acquired at SC1 that is used in order to enter a road the vehicle 3 should travel after passing the guidance-applicable branch specified at SC2. If it is consequently determined that the travel lane specified at SC4 in which the vehicle 3 is actually traveling does not match the lane in which the vehicle 3 should be traveling in the travel route acquired at SC1 (SC5: No), the guidance control unit 21*c* determines that it is necessary to perform guidance pertaining to a lane change, and transmits request information for a guidance point at which guidance pertaining to a lane change should be performed to the vehicle guidance device 10 through the communication unit 70 (SC6). The specific content of the request information may take on any form. For example, the request information may include information that specifies the guidance-applicable branch specified at SC2, the lane in which the vehicle 3 should be traveling, and the lane in which the vehicle 3 is currently traveling.

Once request information is received through the communication unit 11, based on the received request information, the control unit 12 of the vehicle guidance device 10 specifies the guidance point stored in the guidance point DB 13*c* that is associated with the guidance-applicable branch specified at SC2, the lane in which the vehicle 3 should be traveling, and the lane in which the vehicle 3 is currently traveling (an origin lane of a lane change). The control unit 12 of the vehicle guidance device 10 then transmits guidance information that includes the specified guidance point to the in-vehicle device 20 from the communication unit 11 (SC7).

After the guidance information is received from the vehicle guidance device 10 through the communication unit 70, the guidance control unit 21*c* specifies the guidance point based on the received guidance information, and outputs guidance that a lane change should be performed through the speaker 80 and the display 90 when the vehicle 3 reaches the specified guidance point (SC8). The guidance control unit 21*c* then ends the guidance process.

However, if it is determined at SC5 that the travel lane specified at SC4 in which the vehicle 3 is actually traveling matches the lane in which the vehicle 3 should be traveling in the travel route acquired at SC1 (SC5: Yes), the guidance control unit 21*c* determines that it is not necessary to perform guidance pertaining to a lane change, and ends the guidance process.

Effects

According to the first embodiment described above, an inter-vehicle distance, which is an inter-vehicle distance in a prescribed lane, is specified between vehicles 3 up to a reference point of a lane change. Based on the specified inter-vehicle distance, a recommended section in which a lane change to the prescribed lane should be made before reaching the reference point is specified. Based on the specified recommended section, guidance information pertaining to the lane change to the prescribed lane is output. Therefore, it is possible to output guidance so as to enable an easy lane change in a section where there is a large inter-vehicle distance in the destination lane of the lane change. Guidance can thus be performed to facilitate a lane change to the lane.

A plurality of determination sections is set in the prescribed lane within a range up to the reference point. Among the set determination sections, a determination section in which a difficulty specified by the inter-vehicle distance specification unit 12*a* is equal to or greater than a tolerance specified by the tolerable inter-vehicle distance specification unit 12*c* is specified as the recommended section. Therefore, it is possible to output guidance pertaining to a lane change in a section where a lane change is easy and there is a large inter-vehicle distance equal to or greater than the inter-vehicle distance tolerance for performing a lane change. Guidance can thus be performed that further facilitates a lane change.

In particular, a vehicle speed difference is specified between a reference vehicle speed within each determination section of the vehicle 3 traveling in the prescribed lane and a reference vehicle speed within a section that corresponds to each determination section of the vehicle 3 traveling in an origin lane of a lane change to the prescribed lane. The tolerance is specified based on the specified vehicle speed difference. Therefore, it is possible to perform guidance that considers an inter-vehicle distance tolerance that differs depending on the relative vehicle speed between lanes.

In addition, based on congestion information, a determination is made regarding whether there is congestion in the prescribed lane. If it is determined that there is no congestion, the recommended section is specified. Therefore, it is possible to perform guidance that considers the inter-vehicle distance in the destination lane of the lane change when there is no congestion and facilitates a lane change to the lane.

Second Embodiment

A second embodiment of the present invention will be explained here. The second embodiment is a form that sets in advance the tolerable inter-vehicle distance as a fixed value for each reference point and/or prescribed lane. The configuration of the second embodiment is generally identical to the configuration of the first embodiment unless otherwise noted. For configurations generally identical to those of the first embodiment, the same reference symbols and/or names as used in the first embodiment are assigned as necessary and accompanying explanations are omitted.

Constitution: Vehicle Guidance Device—Data Storage Unit

The constitution of the vehicle guidance device 10 according to the second embodiment will be described first. FIG. 9 is a chart that illustrates the tolerance table 13*d* according to the second embodiment. As shown in FIG. 9, information that corresponds to the table items "Reference Point", "Lane", and "Tolerance" is mutually associated and stored in the tolerance table 13*d*. Information that is stored corresponding to the item "Reference Point" specifies a point that serves as a reference for performing a lane change. The node number of a node that is a branch may be stored, for example. Information that is stored corresponding to the item "Lane" specifies a lane. A lane number or the link number that corresponds to each lane may be stored, for example.

Processing: Guidance Point Specification Process

Figure 10:
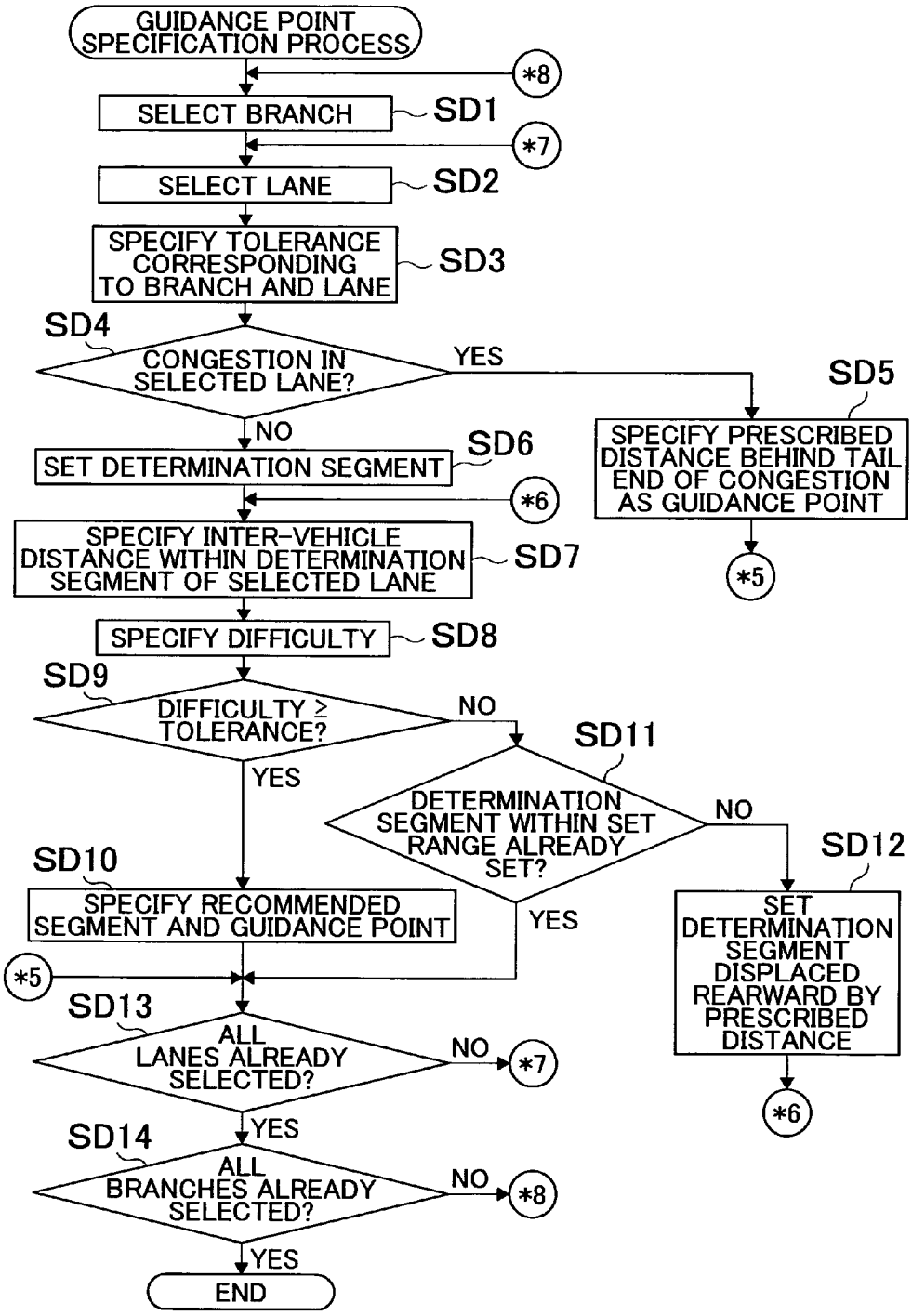
FIG. 10 is a flowchart of the guidance point specification process according to the second embodiment.

The guidance point specification process will be described next. FIG. 10 is a flowchart of the guidance point specification process according to the second embodiment. Note that SD1 and SD2 of the guidance point specification process according to the second embodiment are identical to SB1 and SB2 of FIG. 5, respectively. Likewise, the routine from SD4 to SD8 is identical to the routine from SB3 to SB7, respectively, and the routine from SD10 to SD14 is identical to the routine from SB12 to SB16, respectively. Therefore, such processing will not be further explained here.

Following selection of a lane for which to specify a guidance point at SD2, the tolerable inter-vehicle distance specification unit 12*c* references the tolerance table 13*d* and specifies a tolerance that corresponds to the branch specified as SD1 and the lane specified at SD2 (SD3). In the example of FIG. 9, if the number of the branch specified at SD1 is 10010 and the number of the lane specified at SD2 is 1001011, the corresponding tolerance is specified as 4.

Returning to FIG. 10, at SD8, following specification of the difficulty of a lane change in the determination section set at SD6 or SD12, the recommended section specification unit 12*b* determines whether the difficulty specified at SD8 is equal to or greater than the tolerance specified at SD3 (SD9).

Effects

According to the second embodiment described above, a tolerance that corresponds to a tolerable inter-vehicle distance is a fixed value that is set in advance for each reference point and/or prescribed lane. Therefore, tolerances can be set in advance for each branch and lane depending on the road shape, traffic volume, and the like. It is thus possible to perform guidance that considers this tolerance, and carry out guidance that further facilitates a lane change.

Modifications of the Embodiments

Embodiments of the present invention were explained above. However, the specific configuration and units for implementing the present invention may be modified and improved in any manner or form within the scope of the technical ideas of the present invention as set forth in the claims thereof. Examples of such modifications are explained below.

Problems to be Solved by the Invention and Effects of the Invention

The problems to be solved by the present invention and the effects of the present invention are not limited to the content described above and may vary depending on the environment in which the present invention is practiced and the detailed configuration thereof. The above problems may be only partially solved, and the above effects only partially achieved.

Division and Integration

The electronic constituent elements described above are merely functional concepts, and need not be physically configured as illustrated in the drawings. That is, the specific form of division or integration of each portion is not limited to that shown in the drawings. The constituent elements, as a whole or in part, can be divided or integrated either functionally or physically based on various types of loads or use conditions. For example, the tolerance table 13*d*, the recommended section specification unit 12*b*, and the tolerable inter-vehicle distance specification unit 12*c* may be provided in the in-vehicle device 20, and specification of the recommended section and the guidance point may be performed in the in-vehicle device 20. As an other example, the difficulty specified at SB7 in FIG. 5 by the inter-vehicle distance specification unit 12*a* of the vehicle guidance device 10 may be transmitted to the in-vehicle device 20 at SC7 in FIG. 8. Based on a comparison of the transmitted difficulty and the tolerance specified by the tolerable inter-vehicle distance specification unit 12*c* of the in-vehicle device 20, the recommended section specification unit 12*b* of the in-vehicle device 20 may specify the recommended section and the guidance point.

Difficulty and Tolerance

According to the embodiments described above, in the guidance point specification process, the difficulty is specified based on the inter-vehicle distance, and a determination is made regarding whether it is necessary to specify the recommended section based on a comparison of the difficulty and the tolerance that corresponds to the tolerable inter-vehicle distance. However, the determination regarding whether it is necessary to specify the recommended section may be made based on a comparison of the inter-vehicle distance and the tolerable inter-vehicle distance. In such case, the tolerable inter-vehicle distance is stored in the tolerance table 13*d* in place of the tolerance.

Guidance Point Specification Process

According to the embodiments described above, if it is determined that there is congestion in the lane selected at SB2 or SD2 (SB3: Yes) (SD4: Yes), a point at a guidance distance behind the tail end of the congestion in the lane direction of travel is specified as the guidance point (SB4 or SD5). However, if it is determined that there is congestion, the processes at SB5 or SD6 onward may be performed using the tail end of the congestion as the reference point of a lane change.

In the embodiments described above, as an example, the road for which to specify a guidance point is a road with two lanes in each direction (there is only one possible origin lane for a lane change to a prescribed lane). However, the guidance point specification process may also be executed if the road for which to specify a guidance point is a road with three or more lanes in each direction (there are two possible origin lanes for a lane change to a prescribed lane). In such case, the processing from SB5 to SB14 is performed for every combination of the lane selected at SB2 in FIG. 5 and the origin lanes of the lane change, and a recommended section in which a lane change should be performed to the lane selected at SB2 is specified for every origin lane of the lane change.

Reference Point

In the embodiments described above, as an example, a branch is used as the reference point. However, any other points may be used as the reference point, such as the tail end of the congestion, a point where a lane regulation is in effect, or a point where an object exists.

Reference Signs List

1 Vehicle guidance system
2 Network
3 Vehicle
10 Vehicle guidance device
11, 70 Communication unit
12, 21 Control unit
12*a* Inter-vehicle distance specification unit
12*b* Recommended section specification unit
12*c* Tolerable inter-vehicle distance specification unit
12*d* Congestion information acquisition unit
13, 22 Data storage unit
13*a*, 22*a* Map information DB
13*b* Travel information DB
13*c* Guidance point DB
13*d* Tolerance table
20 In-vehicle device
21*a* Travel information acquisition unit
21*b* Route acquisition unit
21*c* Guidance control unit
30 Inter-vehicle sensor
40 Camera
50 Vehicle speed sensor
60 Current position detection processing unit
80 Speaker
90 Display

The invention claimed is:

1. A vehicle guidance device, comprising:

an inter-vehicle distance specification unit that specifies an inter-vehicle distance, which is an inter-vehicle distance in a prescribed lane, between vehicles up to a reference point of a lane change;

a tolerable inter-vehicle distance specification unit that specifies a tolerable inter-vehicle distance, which is an inter-vehicle distance in the prescribed lane, within which a lane change to the prescribed lane is tolerated;

a recommended section specification unit that:

sets a plurality of determination sections in the prescribed lane within a range up to the reference point, wherein the plurality of determination sections span from each of a plurality of points set at different positions within a range from the reference point to a point therebehind in the lane direction of travel to each of a plurality of points at a determination distance therebehind in the lane direction of travel;

specifies, among the set determination sections, a determination section in which, the specified inter-vehicle distance between vehicles in the determination section is equal to or greater than the specified tolerable inter-vehicle distance as a recommended section in which a lane change to the prescribed lane should be made before reaching the reference point; and specifies a distant point from the reference point among the points of the specified recommended section as a guidance point at which guidance pertaining to the lane change should be performed; and an output unit that, based on the specified recommended section, outputs guidance information pertaining to the lane change to the prescribed lane.

2. The vehicle guidance device according to claim 1, wherein the tolerable inter-vehicle distance specification unit specifies a vehicle speed difference between a reference vehicle speed within each of the determination sections of a vehicle traveling in the prescribed lane and a reference vehicle speed within a section that corresponds to each of the determination sections of a vehicle traveling in an origin lane of a lane change to the prescribed lane, and specifies the tolerable inter-vehicle distance based on the specified vehicle speed difference.

3. A vehicle guidance method, comprising:

specifying, with a control unit, an inter-vehicle distance, which is an inter-vehicle distance in a prescribed lane, between vehicles up to a reference point of a lane change;

specifying, with the control unit, a tolerable inter-vehicle distance, which is an inter-vehicle distance in the prescribed lane, within which a lane change to the prescribed lane is tolerated;

setting, with the control unit, a plurality of determination sections in the prescribed lane within a range up to the reference point, wherein the plurality of determination sections span from each of a plurality of points set at different positions within a range from the reference point to a point therebehind in the lane direction of travel to each of a plurality of points at a determination distance therebehind in the lane direction of travel;

specifying, with the control unit, among the set determination sections, a determination section in which the specified inter-vehicle distance between vehicles in the determination section is equal to or greater than the specified tolerable inter-vehicle distance as a recommended section in which a lane change to the prescribed lane should be made before reaching the reference point;

specifying, with the control unit, a distant point from the reference point among the points of the specified recommended section as a guidance point at which guidance pertaining to the lane change should be performed; and outputting, with the control unit, based on the specified guidance point, guidance information pertaining to the lane change to the prescribed lane.

4. A non-transitory computer-readable storage medium that stores a computer-executable vehicle guidance program, the program comprising:

instructions for specifying an inter-vehicle distance, which is an inter-vehicle distance in a prescribed lane, between vehicles up to a reference point of a lane change;

instructions for specifying a tolerable inter-vehicle distance, which is an inter-vehicle distance in the prescribed lane, within which a lane change to the prescribed lane is tolerated;

instructions for setting a plurality of determination sections in the prescribed lane within a range up to the reference point, wherein the plurality of determination sections span from each of a plurality of points set at different positions within a range from the reference point to a point therebehind in the lane direction of travel to each of a plurality of points at a determination distance therebehind in the lane direction of travel;

instructions for specifying, among the set determination sections, a determination section in which the specified inter-vehicle distance between vehicles in the determination section is equal to or greater than the specified tolerable inter-vehicle distance as a recommended section in which a lane change to the prescribed lane should be made before reaching the reference point;

instructions for specifying a distant point from the reference point among the points of the specified recommended section as a guidance point at which guidance pertaining to the lane change should be performed; and instructions for outputting, based on the specified guidance point, guidance information pertaining to the lane change to the prescribed lane.

* * * * *